US009308556B2

(12) United States Patent
Grosjean et al.

(10) Patent No.: US 9,308,556 B2
(45) Date of Patent: Apr. 12, 2016

(54) METHOD OF GRANULOMETRIC SEPARATION OF MATERIALS RICH IN FILIFORM PARTICLES

(71) Applicant: COMET TRAITEMENTS SA, Chatelet (BE)

(72) Inventors: Philippe Alfred Grosjean, Montigny-le-Tilleul (BE); Pierre-Francois Bareel, Uccle (BE); Claude Bodson, Montigny-le-Tilleul (BE)

(73) Assignee: COMET TRAITEMENTS SA, Chatelet (BE)

( * ) Notice: Subject to any disclaimer, the term of this patent is extended or adjusted under 35 U.S.C. 154(b) by 0 days.

(21) Appl. No.: 14/404,405

(22) PCT Filed: May 30, 2013

(86) PCT No.: PCT/EP2013/061176

§ 371 (c)(1),
(2) Date: Nov. 26, 2014

(87) PCT Pub. No.: WO2013/178738

PCT Pub. Date: Dec. 5, 2013

(65) Prior Publication Data

US 2015/0183004 A1 Jul. 2, 2015

(30) Foreign Application Priority Data

May 30, 2012 (BE) ..... 2012/0360

(51) Int. Cl.

| | |
|---|---|
| ***B07B 13/00*** | (2006.01) |
| ***B07B 13/08*** | (2006.01) |
| ***B07B 13/04*** | (2006.01) |
| ***B07B 4/06*** | (2006.01) |
| ***B07B 7/083*** | (2006.01) |
| ***B07B 13/11*** | (2006.01) |
| ***B07B 13/14*** | (2006.01) |

(52) U.S. Cl.

CPC . *B07B 13/08* (2013.01); *B07B 4/06* (2013.01); *B07B 7/083* (2013.01); *B07B 13/003* (2013.01); *B07B 13/04* (2013.01); *B07B 13/11* (2013.01); *B07B 13/116* (2013.01); *B07B 13/14* (2013.01)

(58) Field of Classification Search

CPC ..... B04C 3/00; B04C 2003/003; B04C 2003/006; B04C 2003/04; B04C 2003/06; B07B 4/06; B07B 7/083; B07B 13/116; B07B 13/14; B07B 13/16

See application file for complete search history.

(56) References Cited

U.S. PATENT DOCUMENTS 3,010,610 A * 11/1961 Marshall ..... B01J 8/003 222/1
3,419,143 A * 12/1968 Levi ..... B07B 13/11 209/481
3,507,387 A * 4/1970 Conrad ..... A22C 17/04 209/2

(Continued)

OTHER PUBLICATIONS

International Search Report Form PCT/ISA/210 for PCT/EP2013/061176 mailed Nov. 4, 2013.

*Primary Examiner* — Prasad Gokhale

(74) *Attorney, Agent, or Firm* — Koppel, Patrick, Heybl & Philpott

(57) ABSTRACT

The present invention relates to a method of selective separation of a granular material comprising a fraction of coarse particles and a fraction of fine particles for separating said fraction of coarse particles from said fraction of fine particles.

9 Claims, 2 Drawing Sheets

(56) References Cited

U.S. PATENT DOCUMENTS 3,612,273 A * 10/1971 Pritchett ..... B07B 13/04 209/687
4,114,762 A * 9/1978 Beal ..... B07B 13/003 209/615
4,185,746 A * 1/1980 Fegan, Jr. ..... B07B 13/11 209/691
4,208,274 A * 6/1980 Satake ..... B07B 13/003 209/44.2
7,497,337 B2 * 3/2009 Tse ..... B02C 17/007 209/284
2012/0325729 A1 * 12/2012 Cappozzo ..... B07B 1/15 209/369
2013/0126401 A1 * 5/2013 Samarkos ..... B03B 9/06 209/645

* cited by examiner

METHOD OF GRANULOMETRIC SEPARATION OF MATERIALS RICH IN FILIFORM PARTICLES

The present invention relates to a method for the selective separation of a granular material including a fraction of coarse particles and a fraction of fine particles in order to separate said fraction of coarse particles from said fraction of fine particles, said method including a step for supplying said granular material, a step for the selective separation of said fraction of coarse particles from the fraction of fine particles, and a step for recovering said separated fraction of coarse particles and said separated fraction of fine particles.

Such a method is for example known from document EP 1,712,301, which discloses a method for separating filiform fragments initially from ground (shredded) electronic elements using an apparatus that is made up of a wheel whose surface is covered by a layer of (textile) fibers on which the filiform fragments will catch when the ground electronic elements fall onto it. When the wheel rotates and under the effect of gravity, the elements not fixed to the layer of fibers will fall into a first recovery tub, while the filiform elements will fall into a second tub when they are subject to gravity and above the second tub. This apparatus is therefore based on falling of the ground electronic elements, which will be driven by the wheel in the same direction as the direction in which the elements fall.

Document EP 726,817 describes a method and an apparatus for separating filiform elements from other elements also coming from electronic material. The principle of this device is identical to that of document EP 1,712,301, with the exception that the surface of a conveyor belt is provided with bristles in which the filiform particles become fastened.

Document DE 4,117,029 relates to the granulometric separation of filiform particles starting from a mixture of particles with different shapes and sizes. The separation of the filiform particles is based on the use of inclined conveyor belts driving the filiform particles upward while the larger particles slide along the conveyor belts under the gravitational force.

Document DE 9,017,891 relates to a method using a device also made up of conveyor belts that are provided, on their surface, with bristles for fixing the filiform particles. The separation of the filiform particles is done identically to the method in document DE 4,117,029, the presence of bristles here reinforcing the rise of the filiform particles to the apex of the belts.

Screening methods are also known from the state of the art for the selective separation of a granular material comprising filiform particles and fine particles. The screening methods are based on the use of screens that make it possible to filter solids of different sizes.

Granulometric separating methods are known in the documents U.S. Pat. No. 4,185,746 and U.S. Pat. No. 3,419,143, but do not pertain to granular materials including filiform particles. These methods are based on the insertion of granular materials including larger particles and fine particles in a rotating circular plate.

Unfortunately, the methods of the state of the art suffer from clogging problems related to the accumulation of filiform elements, for example twisted, at the fibers and bristles of the wheels or belts, which does not make it possible to obtain optimal separation of the filiform elements and elements with different particle sizes. These screening methods also have a relatively long residence time for effective separation of the filiform particles. Furthermore, said filiform particles make up as many additional catching points for other filiform particles, which generally complicates the operations.

The invention aims to offset the drawbacks of the state of the art by procuring a method for selective separation of a granular material including a coarse particle fraction and a fine particle fraction as indicated at the beginning of this document, characterized in that said supply of said granular material is done on a rotating circular plate having a bottom that is inclined relative to a horizontal plane and a central zone for collecting said fine particles, said method further simultaneously including a first movement of said coarse particles in a cascade regime toward a periphery of said rotating circular plate and a second movement of said fine particles in a waterfall regime toward said central collecting zone of said rotating circular plate, by rotating said rotating circular plate at a rotational speed at least equal to 50%, but less than 100% of the critical rotation speed of said rotating circular plate, with the separation of the coarse particle fraction from the fine particle fraction and said recovery of the coarse particle fraction by overflowing the rotating circular plate and said fine particle fraction separated and concentrated in the central collecting zone of said rotating circular plate.

Such a method makes it possible to avoid any costs related to the presence of filiform particles and ensures correct separation of the coarse particle fraction from the fine particle fraction, since each of the two aforementioned fractions is respectively subjected to a particular movement of the material, which results in selectively separating each of the two fractions. In fact, as long as the speed of rotation of said rotating circular plate is at least equal to 50% but less than 100% of the critical speed of rotation, the coarse particle fraction undergoes a movement in a cascade regime while, at the same time, the fine particle fraction undergoes a movement in a cataract regime.

The fine particles, subject to the cataract regime, follow paths passing through the center of said rotating circular plate, where they become concentrated.

The coarse particles, subject to the cascade regime, follow shorter paths than those of the fine particles and do not pass through the center of said rotating circular plate. The cascade regime causes the coarse particles to fall on each other, said coarse particles thus colliding. A collapse and fallout of the coarse particles on themselves is thus obtained.

Aside from the respective movements of each of the two fractions, the granular material is also distributed based on other criteria. On the one hand, under the effect of the rotation of the rotating circular plate, the granular material is pressed against the side edge of said rotating circular plate, and on the other hand, the granular material is distributed in several layers based on the density of the particles, the finest and densest particles forming the lower layers, while the more coarse and less dense particles form the upper layers.

In the moving granular material, gravity plays a role and the coarse particles that are less dense therefore float on the surface of the granular material present on the rotating plate, while the finest particles and the densest particles form a lower layer in contact with the bottom of the rotating circular plate. These particles are driven toward the center of the rotating circular plate under the effect of the rotation of said rotating circular plate and frictional forces exerted between the bottom of the rotating circular plate and said fine particles in contact with the bottom, said fine particles thus being subject to driving forces. These same fine particles transmit the driving forces to which they are subjected to the particles forming the upper layers, said driving forces being transmitted from layer to layer up to the upper layer of the granular material. A driving force gradient perpendicular to the bottom of the rotating circular plate is thus observed, the properties of said driving forces decreasing during their transition from one layer of particles to the next in a rising direction.

As previously mentioned, the rotating circular plate having an incline, the particles are also subjected to gravitational force. The fine particles that are dense, but small and therefore lighter, are not particularly subjected to gravitational force, while the heavier particles, which, although less dense, are more strongly subjected thereto, which drives the latter downward more quickly. Since, as described above, the particles are subjected to driving forces, the effect of the gravitational force on particles results in their ability to follow larger or smaller paths, the densest and lightest fine particles following longer paths than the heavier and less dense particles.

The distribution of the particles in different layers based on their densities, as well as the different paths followed by the particles depending on their densities and the movement of the material (cascade or cataract) to which they are subjected makes it possible to obtain a selective separation, when the movement of the granular material in the rotating circular plate with an inclined bottom is done at a speed of rotation at least equal to 50% but less than 100% of the speed of rotation of said rotating circular plate. According to that particular speed of rotation, movements of the material in the cascade and cataract regimes are surprisingly obtained simultaneously.

The coarse particles float on the surface of the granular material, while fine particles are concentrated at the bottom of the rotating circular plate in a central collecting zone.

The movement regimes of the material in a cylinder (cataract regime, sliding regime, rolling regime, centrifuged regime, collapse regime, cascade regime) are characterized by the Froude number (equation 1), which characterizes the relative significance of the forces related to speed and force of gravity.

$$Fr = \frac{r\omega^2}{g} \quad \text{(equation 1)}$$

where r: the radius of the cylinder [m]

ω: the angular speed [rad/sec]

g: the gravitational force 9.81 [m/s$^2$]

In the context of the present invention and for a predetermined diameter of the rotating circular plate, the Froude number and therefore the movement regime of the material depend on the speed of rotation of the rotating circular plate. It is thus possible to define a critical speed of rotation of the rotating circular plate (Nc) (equation 2) beyond which the cascade and cataract regimes are exceeded to give way to the centrifuged regime characterized by a Froude number equal to 1.

$$Nc = \sqrt{\frac{g\sin\beta}{2\pi^2 D}} \quad \text{(equation 2)}$$

where Nc: the critical driving speed [revolutions/sec]

g: the gravitational force 9.81 [m/s$^2$]

β: the incline angle of the plate

D: the diameter of the plate [m]

It has been observed, in the context of the present invention, that the more the rotating circular plate is inclined relative to a horizontal plane, the more the installation can treat and therefore separate a significant stream of material. In fact, the more the rotating circular plate is inclined, the more it is necessary to increase the speed of rotation to preserve the quality of separation. The increased speed of rotation of the rotating circular plate results in increasing the driving forces, and increasing the incline angle of the rotating circular plate relative to a horizontal plane results in accentuating the effect of the gravitational force on the particles. That is why, under these conditions, the least dense particles are driven downward more quickly, while the denser particles are more quickly oriented toward the central collecting zone of the rotating circular plate, which, consequently, accelerates the separation of the particles with different particle sizes and allows a larger flow rate of granular material to be treated.

The phrase "coarse particle fraction" refers, within the meaning of the present invention, to a granular material fraction including filiform particles and/or larger particles.

"Filiform particles" means, within the present invention, particles having a preferred direction, but also corrugated parts that can wind around themselves or become tangled with each other. These are for example pieces of cables.

The phrase "larger particles" refers, within the meaning of the present invention, to particles with a size between 0.2 and 200 mm.

The phrase "fine particles" refers, within the meaning of the present invention, to particles with a size comprised between 0.01 and 133 mm.

Within the meaning of the present invention, the following ratio must be respected:

$$[(d_{80} \text{ of larger particles})/(d_{80} \text{ of fine particles})]>1.5$$

where $d_{80}$ of larger particles means that 80% of the larger particles of the granular material has a size smaller than a size comprised between 0.2 and 200 mm, and where $d_{80}$ of fine particles means that 80% of the fine particles of the granular material has a size smaller than a size comprised between 0.01 and 133 mm.

Advantageously, according to the method of the present invention, said rotating circular plate has, in a trigonometric reference, a first quadrant extending from 0 to 90°, a second quadrant extending from 90° to 180° and a third quadrant extending from 180° to 270° relative to a 0 point corresponding to a highest point of the rotating circular plate when the latter is stopped, said filiform particles and/or said larger particles being recovered in a peripheral collector in the form of a fixed descending ramp along at least part of said third quadrant of said rotating circular plate, preferably along an arc between 180° and 270°, after they have overflowed said rotating circular plate, said filiform particles agglomerating in the form of balls. Such a position of the peripheral collector ensures optimal recovery of the filiform particles agglomerated in the form of balls which, by overflowing said rotating circular plate, fall into said collector, which orients them toward a collecting zone.

Preferably, according to the method of the present invention, said recovery of said fine particles in the central collecting zone of the inclined rotating circular plate is done manually, preferably by suction, preferably using a least one opening formed in the bottom of said central collecting zone, preferably using a worm screw.

Advantageously, according to the method of the present invention, a separation of said larger particles from said filiform particles agglomerated in the form of balls is done using a finger screen situated in the extension of said peripheral collector. The larger particles pass through the fingers of said finger screen and are thus located in a first recovery tub, while balls remain on the surface of the finger screen and are oriented toward a second recovery tub situated downstream from said first recovery tub.

Preferably, according to the method of the present invention, the rotating circular plate is inclined by an angle a of between 20° and 80°, preferably between 30 and 60°, preferably between 45 and 55° relative to a horizontal plane.

Other embodiments of the method according to the invention are indicated in the appended claims.

The invention also relates to a device for the selective separation of a granular material including a coarse particle fraction and a fine particle fraction, said device including a supply of said granular material, a rotating element, a first zone for collecting said coarse particle fraction and a second zone for collecting said separated fine particle fraction, characterized in that said rotating element is a rotating circular plate having a bottom inclined relative to a horizontal plane and a peripheral edge extending outwardly flared from the bottom, said second collecting zone for said fine particle fraction being situated in a central zone of said rotating circular plate.

Such a device for separating a granular material including coarse particles (filiform+larger) and fine particles advantageously makes it possible to avoid any clogging related to the presence of filiform particles, the separation not using elements provided with fibers or bristles and not using screens, but instead using a rotating circular plate having an inclined bottom relative to a horizontal plane and a peripheral edge extending upwardly flared from a bottom. Furthermore, this device allows a selective separation, said filiform elements agglomerated in the form of balls as well as the larger particles being recovered at the periphery of said rotating plate, whereas such fine particles are concentrated at the center of said rotating plate in said collecting zone for the fine particles.

Advantageously, in the device according to the present invention, said coarse particle fraction includes filiform particles and/or larger particles.

Preferably, in the device according to the present invention, said rotating circular plate has four quadrants, a first quadrant extending from 0 to 90°, a second quadrant extending, in a trigonometric reference, from 90° to 180°, and a third quadrant extending from 180° to 270° relative to a 0 point corresponding to a highest point of said rotating circular plate when the latter is stopped, said first zone for collecting the coarse particles being a fixed downward ramp along at least part of the third quadrant of the rotating circular plate, preferably along an arc between 180° and 270°.

Advantageously, in the device according to the present invention, said second collecting zone for the fine particles includes at least one opening formed on the bottom of said central collecting zone or a worm screw.

Equally advantageously, in the device according to the present invention, said downward ramp is extended by a finger screen ensuring separation between said filiform particles agglomerated in the form of balls and said larger particles.

Other embodiments of the device for separating a granular material according to the invention are indicated in the appended claims.

The invention further relates to the use of the device for the selective separation of the coarse particle fraction from the fine particle fraction of a granular material.

Other usage embodiments of the device for separating a granular material according to the invention are indicated in the appended claims.

Other features, details and advantages of the invention will emerge from the description provided below, non-limitingly and in reference to the appended drawings.

In the figures, identical or similar elements that are the same bear the same references.

Figure 1:
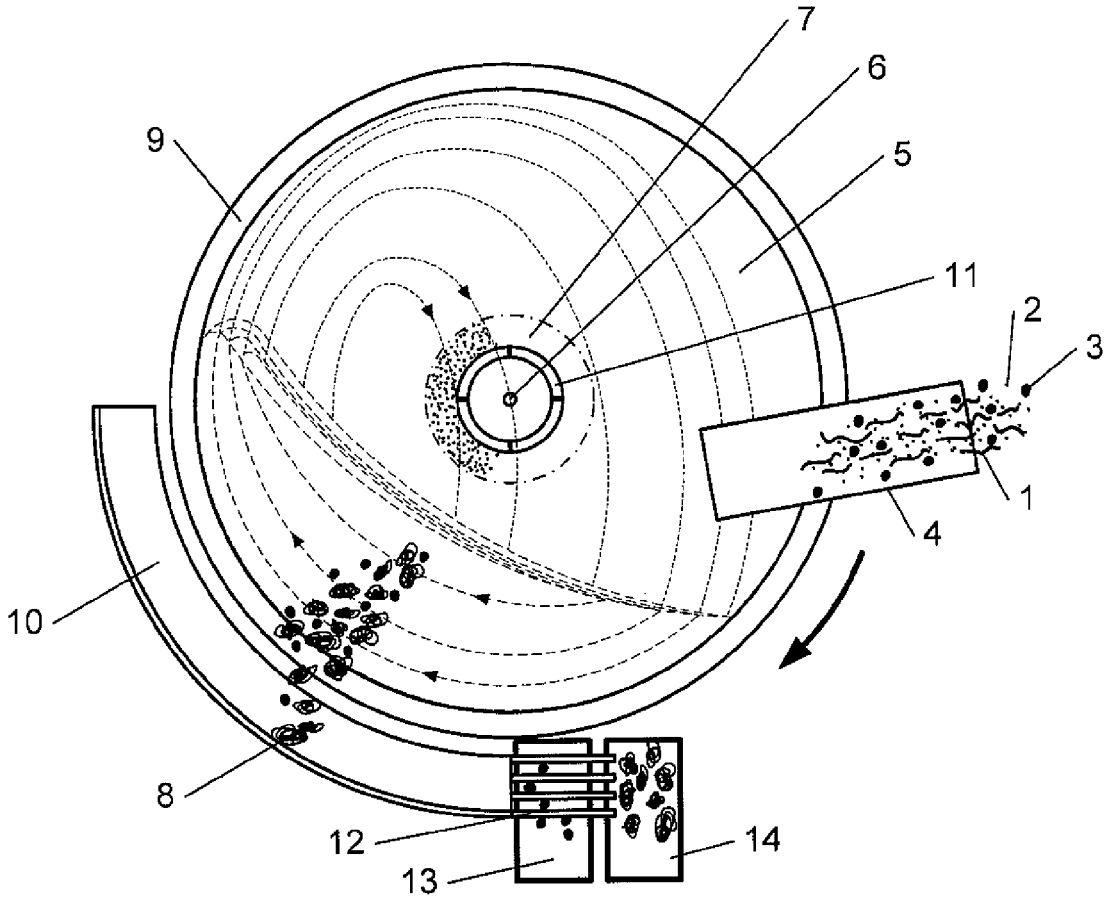
FIG. 1 illustrates an embodiment of the device for separating a granular material according to the invention.

FIG. 1 illustrates an embodiment of the device for separating a granular material according to the invention. The granular material, which comprises filiform particles (1), fine particles (2) and larger particles (3), is introduced into the rotating circular plate (5) by a supply ramp (4). The rotating circular plate (5) is inclined by an angle α (indicated in FIG. 3) relative to a horizontal plane and rotates around a central axis (6) in the clockwise direction (direction indicated by the arrow) at a speed of rotation at least equal to 50% but less than 100% of the critical speed of rotation of said rotating circular plate (5) so that the movements of the material in the cascade regime (movement illustrated by the long dashed lines) and cataract regime (movement illustrated by the short dashed lines) are obtained simultaneously.

The fine particles (2) are subjected to a cataract regime and follow paths passing through the central collecting zone (7), where they accumulate.

The filiform particles (1) and the larger particles (3) undergo the cascade regime, which causes the coarse particles (filiform+larger) to fall on each other. This results in the filiform particles (1) colliding with each other and forming balls (8), while becoming tangled with each other. The filiform particles in the form of balls (8) as well as the larger particles (3) float to the surface of the supplied granular material and are recovered by overflowing above the peripheral edge (9) of the rotating circular plate (5), after they are driven downward by gravitational force, in a peripheral collector (10). The fine particles (2) are concentrated at the bottom of the rotating circular plate (5) in the central collecting zone (7) and are recovered by flowing through openings (11) formed in said central collecting zone (7) near said axis of rotation (6). Said peripheral collector (10) is extended by a finger screen (12) allowing the larger particles (3) sliding along said peripheral collector (10) to fall into a first recovery tub (13) through the fingers of said finger screen (12). The filiform particles in the form of balls (8) slide on the finger screen (12) before being recovered in a second recovery tub (14).

Figure 2:
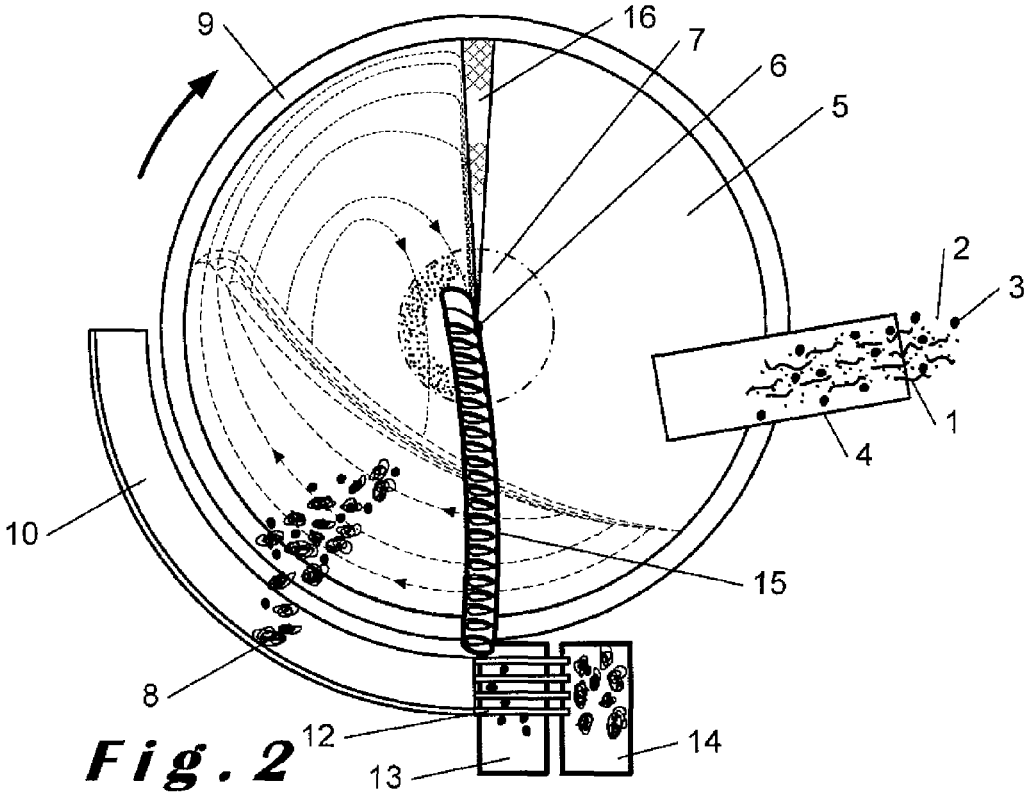
FIG. 2 illustrates another embodiment of the device for separating a granular material according to the invention.

FIG. 2 illustrates another embodiment of the device for separating a granular material according to the invention and is identical to FIG. 1, with the exception that a worm screw (15) recovers the fine particles (2) concentrated at the bottom of the rotating circular plate (5) in the central collecting zone (7) near said axis of rotation (6). Furthermore, according to this embodiment, a deflector (16) orients the fine particles (2) toward the central collecting zone (7) [where one] end of said worm screw (15) is arranged to remove such fine particles (2) agglomerated in said central collecting zone (7).

Figure 3:
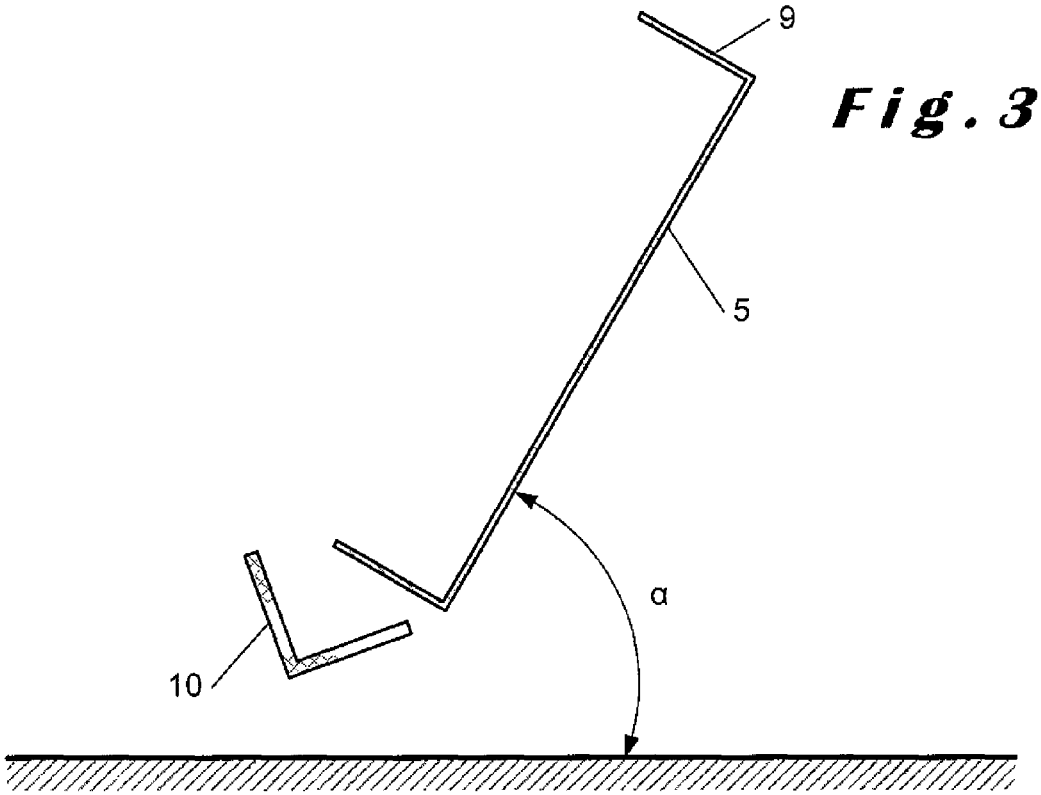
FIG. 3 is a profile view of the device for separating a granular material according to the invention.

FIG. 3 is a profile view of the device for separating a granular material according to the invention where the incline angle (α) of the rotating circular plate (5) is illustrated.

EXAMPLES

A residue from grinding waste from electrical and electronic equipment, having previously undergone a first separation, for example magnetic or by Foucault current, is introduced on a rotating circular plate having a diameter of 1 m, a peripheral edge 15 cm high (overflow height) and a central deflector.

The grinding residue introduced onto the plate includes filiform particles (for example, sheathed or unsheathed electrical wires), coarse (larger) plastic and metal particles and fine (mineral fraction) particles.

Several granulometric separation tests have been conducted by varying the parameters below as indicated in the table:

- the incline of the rotating circular plate by an angle a relative to a horizontal plane,
- the supply rate of the ground residue on the inclined rotating circular plate,
- the mass of the treated ground residue,
- the quantities (%) of coarse particles and fine particles making up the ground residue,
- the quantities (%) of coarse particles having a size larger than 5 mm and the quantities (%) of fine particles having a size smaller than 5 mm,
- the speed of rotation of the rotating circular plate and, consequently, the % of the critical speed of rotation of the inclined rotating circular plate.

| | α | Flow rate (kg/h) | Treated mass (kg) | % coarse | % fine | % coarse >5 mm | % fine <5 mm | Speed of rotation (rpm) | % critical speed of rotation |
|---|---|---|---|---|---|---|---|---|---|
| 1 | 55 | 506 | 240 | 13 | 87 | 91 | 78 | 34 | 89 |
| 2 | 55 | 513 | 240 | 17 | 83 | 90 | 74 | 34 | 89 |
| 3 | 55 | 729 | 240 | 31 | 69 | 76 | 76 | 31 | 81 |
| 4 | 55 | 1000 | 1571 | 26 | 74 | 81 | 77 | 28 | 73 |
| 5 | 45 | 217 | 240 | 10 | 90 | 91 | 82 | 26 | 73 |
| 6 | 50 | 534 | 240 | 12.5 | 87.5 | 83 | 79 | 24 | 65 |

All of these tests made it possible to perform a satisfactory selective granulometric separation, the coarse particles being moved in a cascade regime toward the periphery of the inclined rotating circular plate, the fine particles being move toward a central collecting zone of the inclined rotating circular plate in a cataract regime and the filiform particles agglomerating between them in the form of balls on the surface of the ground residue. The coarse particles as well as the filiform particles agglomerated in the form of balls were recovered, by overflowing the circular plate, in a peripheral collector before being separated from each other by passing over a finger screen. The fine particles were recovered at the center of the rotating circular plate, either by means of an opening formed in the bottom of the central collecting zone or using a worm screw.

Optimal saturation was nevertheless obtained by applying the parameters of test no. 4, where it was shown that a longer treatment duration of the ground residue allowed approximately a 30% increase in the supply rate of the granular material on the inclined rotating circular plate without reducing the quality of the obtained separation.

Of course, the invention is in no way limited to the embodiments described above, and modifications may be made thereto without going beyond the scope of the appended claims.

The invention claimed is:

1. A method for the selective separation of a granular material including a fraction of coarse particles and a fraction of fine particles in order to separate said fraction of coarse particles from said fraction of fine particles, said method including:

- a step for supplying said granular material;
- a step for the selective separation of said fraction of coarse particles from the fraction of fine particles, and
- a step for recovering said separated fraction of coarse particles and said separated fraction of fine particles;
- said supply of said granular material being done on a rotating circular plate having a bottom that is inclined relative to a horizontal plane and a central zone for collecting said fine particles;
- said method further simultaneously including a first movement of said coarse particles in a cascade regime toward a periphery of said rotating circular plate and a second movement of said fine particles being driven by frictional forces exerted between the bottom of the rotating circular plate and said fine particles son that these latter follow a waterfall regime toward said central collecting zone of said rotating circular plate, by rotating said rotating circular plate at a rotational speed at least equal to 50%, but less than 100% of the critical rotation speed of said rotating circular plate defined as follows:

$$Nc = \sqrt{\frac{g\sin\beta}{2\pi^2 D}}$$

where Nc represents the critical driving speed, g represents the gravitational force 9.81 m/s$^2$, β represents the incline angle of the plate, and D represents the diameter of the plate;

- with the separation of the coarse particle fraction from the fine particle fraction and said recovery of the coarse particle fraction by overflowing the rotating circular plate and said fine particle fraction separated and concentrated in the central collecting zone of said rotating circular plate;
- said method being characterized in that said step for supplying a granular material supplies said rotating circular plate with a coarse particle fraction comprising filiform particles and in that it further comprises a step for agglomerating said filiform particles in the form of balls and a step for separating said balls by overflowing said rotating circular plate.

2. The method for the selective separation of a granular material according to claim 1, characterized in that said coarse particle fraction comprises larger particles.

3. The method for the selective separation of a granular material according to claim 2, characterized in that a separation of said larger particles from said filiform particles agglomerated in the form of balls is done using a finger screen situated in the extension of said peripheral collector.

4. The method for the selective separation of a granular material according to claim 1, characterized in that said rotating circular plate has, in a trigonometric reference, a first quadrant extending from 0 to 90° , a second quadrant extending from 90° to 180° and a third quadrant extending from 180° to 270° relative to a 0 point corresponding to a highest point of the rotating circular plate when the latter is stopped, and in that said filiform particles are recovered in a peripheral collector in the form of a fixed descending ramp along at least part of said third quadrant of said rotating circular plate, preferably along an arc between 180° and 270° , after they have overflowed said rotating circular plate, said filiform particles agglomerating in the form of balls.

5. The method for the selective separation of a granular material according to claim 1, characterized in that said recovery of said fine particles in the central collecting zone of the inclined rotating circular plate is done by suction, using a least one opening formed in the bottom of said central collecting zone.

6. The method for the selective separation of a granular material according to claim 1, characterized in that filiform particles and larger particles are recovered in the peripheral collector.

7. The method for the selective separation of a granular material according to claim 1, characterized in that said recovery of said fine particles in the central collecting zone of the inclined rotating circular plate is done by using a worm screw.

8. A device for the selective separation of a granular material including a coarse particle fraction and a fine particle fraction comprising filiform particles and larger particles, said device including:

a supply of said granular material;

a rotating element;

a first zone for collecting said coarse particle fraction; and a second zone for collecting said separated fine particle fraction;

said rotating element being a rotating circular plate having a bottom inclined relative to a horizontal plane and a peripheral edge extending outwardly flared from the bottom;

said second collecting zone for said fine particle fraction being situated in a central zone of said rotating circular plate;

said fine particle fraction being driven by frictional forces exerted between the bottom of the rotating circular plate and said fine particle fraction so that these latter follow a waterfall regime to reach the central zone, said rotating circular plate comprising four quadrants, a first quadrant extending from 0 to 90° , a second quadrant extending, in a trigonometric reference, from 90° to 180° , and a third quadrant extending from 180° to 270° relative to a 0 point corresponding to a highest point of said rotating circular plate when the latter is stopped, said device being characterized in that said first zone for collecting the coarse particles comprising filiform particles and larger particles is a fixed downward ramp following a circumference of the rotating circular plate along at least part of the third quadrant of the rotating circular plate and in that said downward ramp is extended by a finger screen ensuring separation between said filiform particles agglomerated in the form of balls and said larger particle.

9. The device for the selective separation of a granular material according to claim 8, characterized in that said second collecting zone for the fine particles includes at least one opening formed on the bottom of said central collecting zone or a worm screw, said fine particles (2) being driven by frictional forces exerted between the bottom of the rotating circular plate (5) and said fine particles (2) so that these latter follow a waterfall regime to reach the central collecting zone (7).

* * * * *